US009829822B2

(12) United States Patent
Omori et al.

(10) Patent No.: US 9,829,822 B2
(45) Date of Patent: Nov. 28, 2017

(54) ROLLER MEMBER, IMAGE CARRIER DEVICE, AND IMAGE FORMING APPARATUS

(71) Applicant: FUJI XEROX CO., LTD., Tokyo (JP)

(72) Inventors: Kenji Omori, Kanagawa (JP); Koichi Matsumoto, Kanagawa (JP); Tomotake Inagaki, Kanagawa (JP); Shogo Tomari, Kanagawa (JP); Junji Okada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/000,649

(22) Filed: Jan. 19, 2016

(65) Prior Publication Data

US 2017/0052469 A1 Feb. 23, 2017

(30) Foreign Application Priority Data

Aug. 21, 2015 (JP) ..... 2015-164064

(51) Int. Cl.
*G03G 15/02* (2006.01)

(52) U.S. Cl.
CPC . *G03G 15/0233* (2013.01); *G03G 2215/0132* (2013.01); *G03G 2215/025* (2013.01)

(58) Field of Classification Search
None
See application file for complete search history.

(56) References Cited

U.S. PATENT DOCUMENTS

| | | | | |
|---|---|---|---|---|
| 5,497,219 | A * | 3/1996 | Kurokawa | G03G 15/0233 361/225 |
| 5,790,927 | A * | 8/1998 | Ando | G03G 15/0233 399/174 |
| 2007/0012549 | A1* | 1/2007 | Kanaris | B65G 39/02 198/835 |
| 2007/0231719 | A1* | 10/2007 | Nishimura | G03G 5/04 430/56 |

FOREIGN PATENT DOCUMENTS

| | | | |
|---|---|---|---|
| JP | 8-160714 | A | 6/1996 |
| JP | 0973211 | A | 3/1997 |
| JP | 2008-15032 | A | 1/2008 |
| JP | 2009-96085 | A | 5/2009 |

OTHER PUBLICATIONS

Communication dated Jun. 6, 2017 from the Japanese Patent Office in counterpart Japanese application No. 2015-164064.

* cited by examiner

*Primary Examiner* — Victor Verbitsky
(74) *Attorney, Agent, or Firm* — Sughrue Mion, PLLC

(57) ABSTRACT

A roller member includes a core member; a substantially round-cylindrical elastic member through which the core member extends and having chamfered portions, the chamfered portions each provided at two respective ends of the elastic member and having a surface roughness of about 50 μm or less; and a coating film provided over an outer peripheral surface of the elastic member and at least a part of each of the chamfered portions.

6 Claims, 12 Drawing Sheets

FIG. 3

| | SURFACE ROUGHNESS | EVALUATION |
|---|---|---|
| WORKING EXAMPLE 1 | 30 | A |
| WORKING EXAMPLE 2 | 40 | A |
| WORKING EXAMPLE 3 | 50 | A |
| COMPARATIVE EXAMPLE 1 | 90 | B |
| COMPARATIVE EXAMPLE 2 | 100 | B |
| COMPARATIVE EXAMPLE 3 | 110 | B |

ROLLER MEMBER, IMAGE CARRIER DEVICE, AND IMAGE FORMING APPARATUS

CROSS-REFERENCE TO RELATED APPLICATIONS

This application is based on and claims priority under 35 USC 119 from Japanese Patent Application No. 2015-164064 filed Aug. 21, 2015.

BACKGROUND

Technical Field

The present invention relates to a roller member, an image carrier device, and an image forming apparatus.

SUMMARY

According to an aspect of the invention, there is provided a roller member including a core member; a substantially round-cylindrical elastic member through which the core member extends and having chamfered portions, the chamfered portions each provided at two respective ends of the elastic member and having a surface roughness of about 50 μm or less; and a coating film provided over an outer peripheral surface of the elastic member and at least a part of each of the chamfered portions.

BRIEF DESCRIPTION OF THE DRAWINGS

An exemplary embodiment of the present invention will be described in detail based on the following figures, wherein:

FIG. 3 is a table that summarizes results of an evaluation of charging rollers made as working examples according to the exemplary embodiment of the present invention and charging rollers made as comparative examples;

DETAILED DESCRIPTION

A roller member and an image forming apparatus according to an exemplary embodiment of the present invention will now be described with reference to FIGS. 1A to 12, in which an arrow H1 represents the apparatus-top-bottom direction (vertical direction) of the image forming apparatus, an arrow W1 represents the apparatus-width direction (horizontal direction) of the image forming apparatus, and an arrow D1 represents the apparatus-depth direction (horizontal direction) of the image forming apparatus.

Image Forming Apparatus

Figure 12:
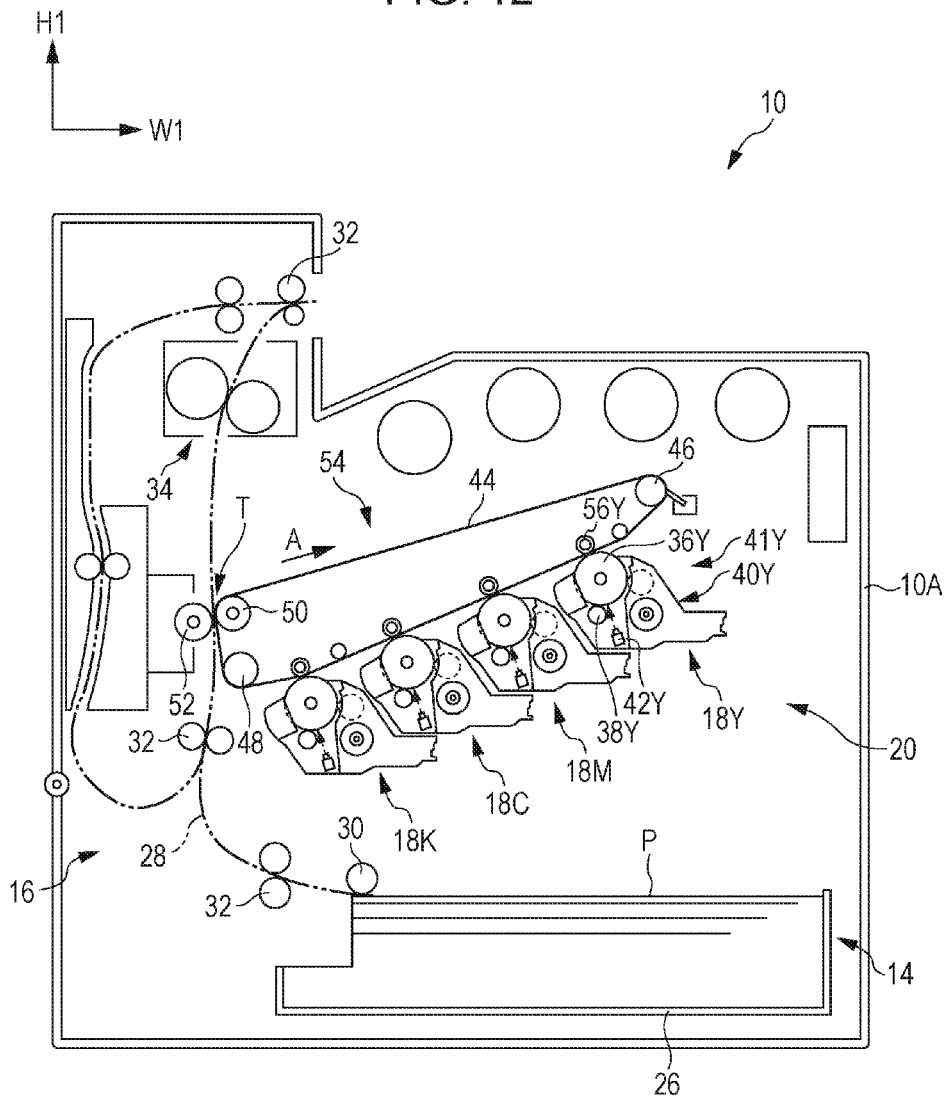
FIG. 12 is a schematic diagram illustrating an image forming apparatus according to the exemplary embodiment of the present invention.

Referring to FIG. 12, an image forming apparatus 10 according to the present exemplary embodiment includes, in order from the lower side toward the upper side in the top-bottom direction (indicated by the arrow H1), a container section 14 that contains sheet members P as recording media, a transport section 16 that transports each of the sheet members P contained in the container section 14, and an image forming section 20 that forms an image on the sheet member P transported from the container section 14 by the transport section 16.

Container Section

The container section 14 includes a container member 26 that is drawable from an apparatus body 10A of the image forming apparatus 10 toward the near side in the apparatus-depth direction. The sheet members P are stacked in the container member 26. The container section 14 further includes a feeding roller 30 that feeds each of the sheet members P stacked in the container member 26 into a transport path 28 included in the transport section 16.

Transport Section

The transport section 16 includes plural pairs of transport rollers 32 that transport the sheet member P along the transport path 28.

Image Forming Section

The image forming section 20 includes four image forming units 18Y, 18M, 18C, and 18K provided for yellow (Y), magenta (M), cyan (C), and black (K), respectively. The image forming section 20 further includes a transfer unit 54 that transfers toner images formed by the image forming units 18 for the respective colors to the sheet member P, and a fixing device 34 that fixes the toner images on the sheet member P by applying heat and pressure to the toner images. Hereinafter, the suffixes Y, M, C, and K are omitted occasionally if the elements to be described do not need to be distinguished from one another by the suffixes Y, M, C, and K. Note that the image forming units 18Y, 18M, 18C, and 18K are each an exemplary image carrier device.

Image Forming Unit

The image forming units 18 for the respective colors each include an image carrier 36, a charging device 38 that charges the surface of the image carrier 36, and an exposure device 42 that applies exposure light generated for a corresponding one of the colors to the charged image carrier 36 and thus forms an electrostatic latent image on the image carrier 36. The image forming units 18 further includes a developing device 40 that develops and visualizes the electrostatic latent image into a toner image. The exposure device 42 and the developing device 40 constitute a forming unit 41.

Transfer Unit

The transfer unit 54 is provided above the image forming units 18 for the respective colors. The transfer unit 54 includes a transfer belt 44 as an exemplary endless belt, and a driving roller 46 around which the transfer belt 44 is wrapped. With the rotation of the driving roller 46, the transfer belt 44 is rotated in the direction of an arrow A. The transfer unit 54 further includes a tension applying roller 48 around which the transfer belt 44 is wrapped and that applies tension to the transfer belt 44, an assist roller 50 provided above the tension applying roller 48 and that rotates by following the rotation of the transfer belt 44, and first transfer rollers 56 provided across the transfer belt 44 from the respective image carriers 36.

The transfer unit 54 further includes a second transfer roller 52 provided across the transfer belt 44 from the assist roller 50 and that transfers the toner images transferred to the transfer belt 44 to the sheet member P transported thereto.

The charging device 38 will be described in detail later.

Operation of Image Forming Apparatus

The image forming apparatus 10 forms an image as follows.

First, the charging devices 38 for the respective colors negatively charge the surfaces of the respective image carriers 36 uniformly with a predetermined potential. Subsequently, on the basis of pieces of image data inputted from an external device, the exposure devices 42 for the respective colors apply exposure light to the charged surfaces of the respective image carriers 36, whereby electrostatic latent images are formed, respectively.

Thus, the electrostatic latent images corresponding to the pieces of image data are formed on the surfaces of the image carriers 36, respectively. Then, the developing devices 40 develop and visualize the electrostatic latent images into toner images, respectively. Subsequently, the first transfer rollers 56 transfer the respective toner images formed on the surfaces of the image carriers 36 to the transfer belt 44.

Meanwhile, the sheet member P fed from the container member 26 into the transport path 28 by the feeding roller 30 is transported to a transfer position T, where the transfer belt 44 is in contact with the second transfer roller 52. At the transfer position T, the second transfer roller 52 and the transfer belt 44 transport the sheet member P while nipping the sheet member P therebetween, whereby the toner images on the surface of the transfer belt 44 are transferred to the sheet member P.

Subsequently, the fixing device 34 fixes the toner images transferred to the sheet member P. The sheet member P having the fixed toner images is discharged to the outside of the apparatus body 10A by a pair of transport rollers 32.

Featured Elements

Now, featured elements such as the charging device 38 will be described.

Figure 11:
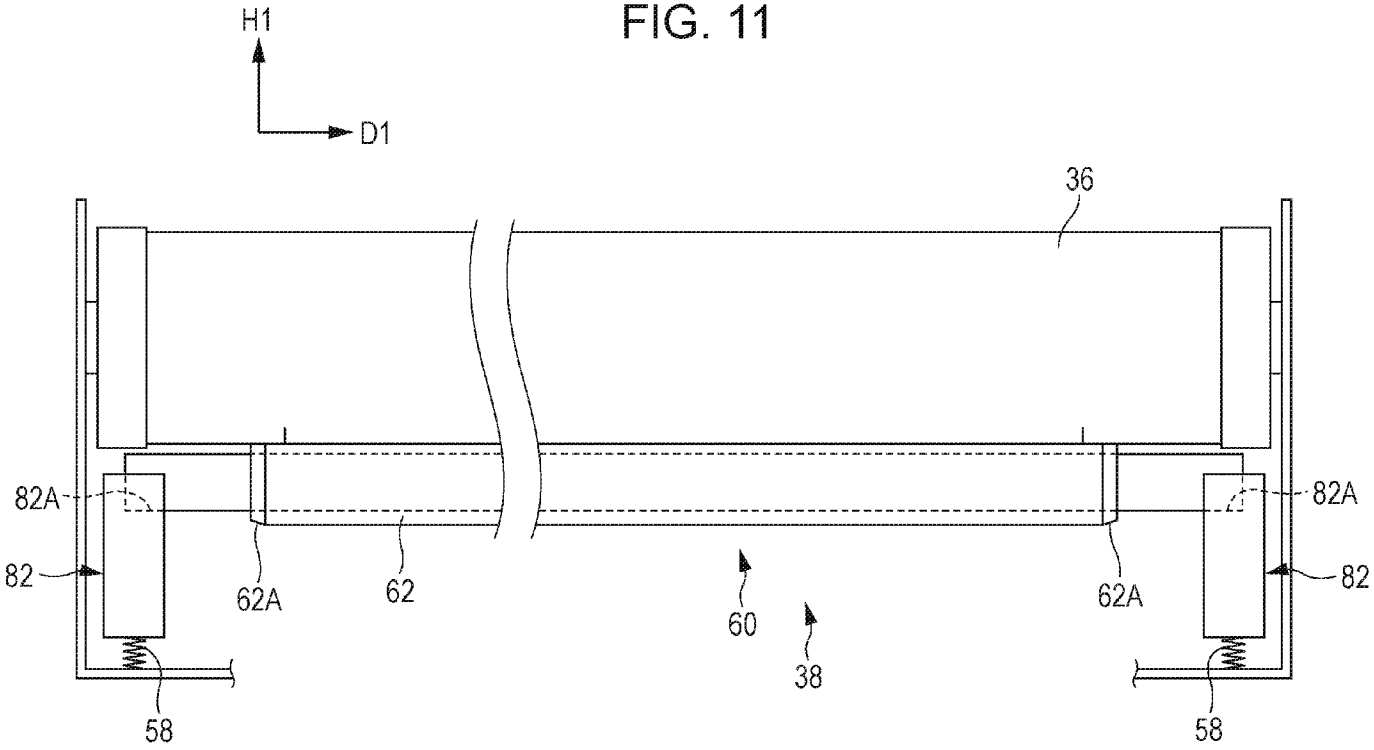
FIG. 11 is a front view of the charging roller, an image carrier, and other associated elements according to the exemplary embodiment of the present invention.

Referring to FIG. 11, the charging device 38 includes a charging roller 60 as an exemplary roller member, and supporting members 82 that support the charging roller 60. The charging roller 60 is in contact with the image carrier 36 that rotates. The charging roller 60 rotates by following the rotation of the image carrier 36.

Supporting Member

The supporting members 82 are provided at two respective ends of the charging roller 60. The charging roller 60 extends in the axial direction of the image carrier 36. The supporting members 82 each have a groove 82A at which a corresponding one of the two ends of the charging roller 60 is supported. Furthermore, an urging member 58 is provided across a corresponding one of the supporting members 82 from the image carrier 36. The urging members 58 urge the respective supporting members 82, thereby pressing the charging roller 60 against the image carrier 36.

Since the urging members 58 urge the charging roller 60 toward the image carrier 36, a rubber roller portion 62 to be described below is deformed, whereby an outer peripheral surface 62B and chamfered portions 62A of the rubber roller portion 62 are pressed against the image carrier 36.

Charging Roller

Figure 4:
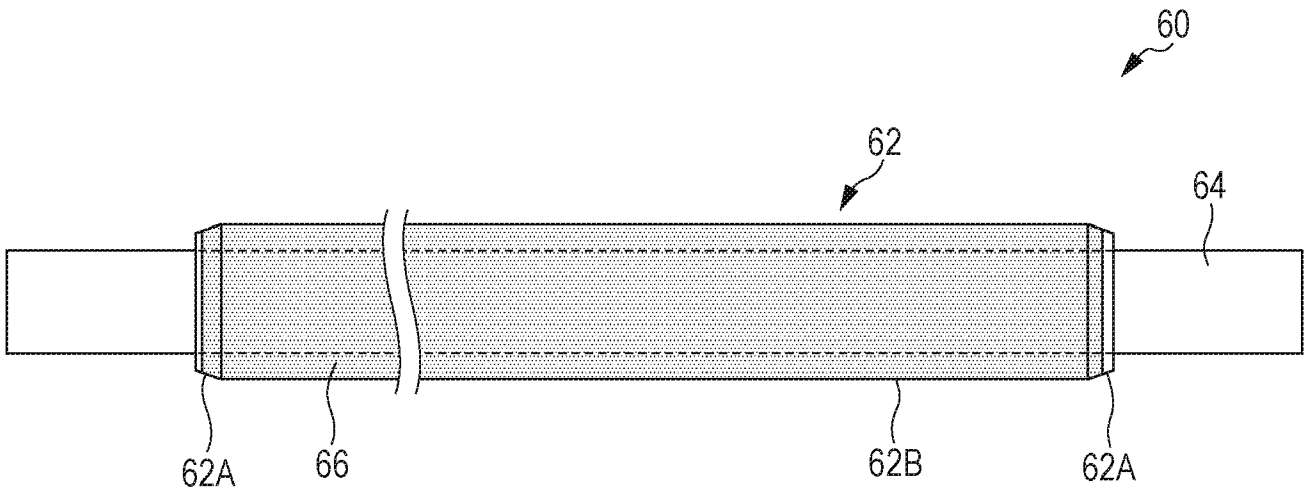
FIG. 4 is a front view of the charging roller according to the exemplary embodiment of the present invention.

Referring to FIG. 4, the charging roller 60 includes the rubber roller portion 62 as an exemplary round-cylindrical or substantially round-cylindrical elastic member, and a shaft member 64 as an exemplary round-columnar core member. The shaft member 64 extends through the rubber roller portion 62.

Exemplary sizes of the elements included in the charging roller 60 according to the present exemplary embodiment are as follows. The shaft member 64 has a diameter of 8 mm and a length of 355 mm. The rubber roller portion 62 has an outside diameter of 12 mm and a length of 320 mm. The rubber roller portion 62 is made of, for example, epichlorohydrin rubber or acrylonitrile-butadiene copolymer rubber. The shaft member 64 is, for example, a SUM-Ni shaft (a shaft made of sulfurized free-machining steel that is plated with nickel).

Figure 1A:
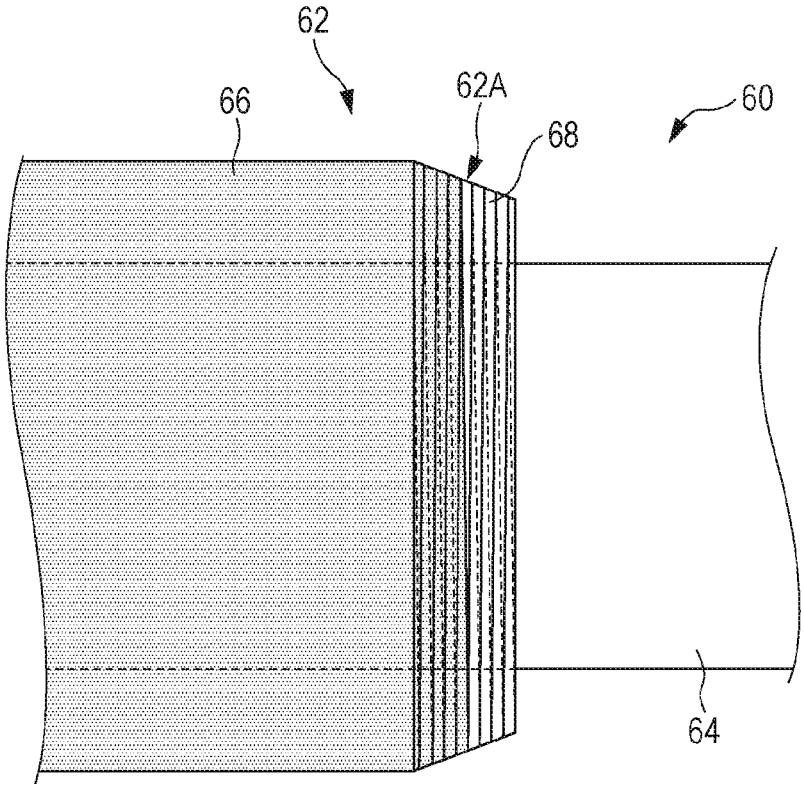
FIG. 1A is a front view of a chamfered portion of a charging roller according to the exemplary embodiment of the present invention.
Figure 1B:
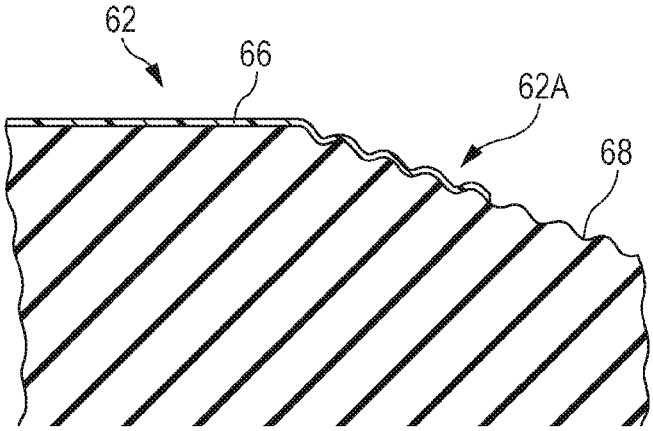
FIG. 1B is a sectional view of the chamfered portion of the charging roller according to the exemplary embodiment of the present invention.

The two ends of the rubber roller portion 62 are chamfered, whereby the chamfered portions 62A are provided. Referring to FIGS. 1A and 1B, the chamfered portions 62A each have a helical or substantially helical groove 68 (hereinafter simply referred to as helical groove 68), thereby having a surface roughness Rz (JIS B 0601-1994) of 50 μm or about 50 μm or less. The helical groove 68 is provided by using a cutter 132 having an edge 136A in a cutting step, to be described later, for forming the chamfered portion 62A.

Referring to FIG. 4, a part of each of the chamfered portions 62A of the rubber roller portion 62 and the entirety of the outer peripheral surface 62B of the rubber roller portion 62 are covered with an electrically conductive coating film 66 as an exemplary coating film. The electrically conductive coating film 66 is formed by flow coating and has an average thickness of, for example, 10 μm. The electrically conductive coating film 66 is made of polymeric resin in which an electrically conductive substance is dispersed.

The surface roughness of each of the chamfered portions 62A is measurable over the entire periphery thereof by using SURFCOM 1500DX3 (manufactured by TOKYO SEIMITSU CO., LTD.) after the electrically conductive coating film 66 is removed from the chamfered portion 62A by using a solvent that does not melt rubber (for example, lower alcohol such as ethanol or isopropyl alcohol).

An end processing apparatus 100 that chamfers the ends of the rubber roller portion 62 will now be described.

End Processing Apparatus

The end processing apparatus 100 is a machine (see FIG. 5) for cutting each of corners 70B of a round-cylindrical or substantially round-cylindrical rubber roller member 70 (having an annular sectional shape), whereby the rubber roller portion 62 having the chamfered portions 62A is obtained.

Figure 5:
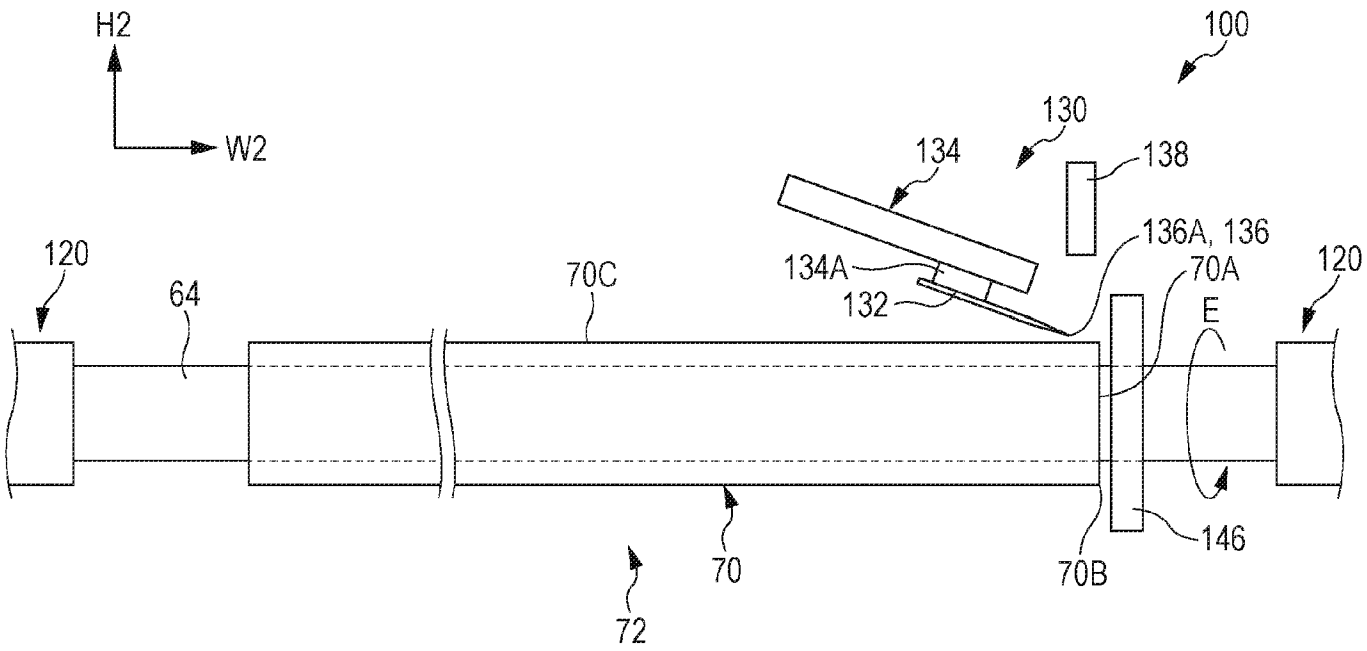
FIG. 5 is a front view of an end processing apparatus used in manufacturing the charging roller according to the exemplary embodiment of the present invention.

In FIG. 5 and other drawings, an arrow H2 represents the apparatus-top-bottom direction (vertical direction) of the end processing apparatus 100, and an arrow W2 represents the apparatus-width direction (horizontal direction) of the end processing apparatus 100.

Hereinafter, for distinguishing from the charging roller 60 including the rubber roller portion 62 and the shaft member 64, a structure including the rubber roller member 70, which is yet to be chamfered, and the shaft member 64 is referred to as unprocessed rubber roller 72.

As illustrated in FIG. 5, the end processing apparatus 100 includes a rotating device 120 that rotates the unprocessed rubber roller 72, and a cutting device 130 including a blade 136 with which each of the corners 70B of the rubber roller member 70 is cut. The end processing apparatus 100 further includes a supporting pad 146 that supports an end face 70A of the rubber roller member 70, and a blowing member 138 that blows air to an axial-end portion of the rubber roller member 70.

Rotating Device

The rotating device 120 supports the two ends of the shaft member 64 of the unprocessed rubber roller 72 and rotates the unprocessed rubber roller 72 (the rubber roller member 70) in the peripheral direction (represented by an arrow E in FIG. 5) of the rubber roller member 70. In the present exemplary embodiment, the rotating device 120 rotates the unprocessed rubber roller 72 at a speed of 50 rpm.

Cutting Device

The cutting device 130 includes the cutter 132 having the blade 136, and a driving unit 134. The driving unit 134 includes an oscillator (not illustrated) that oscillates the cutter 132 with ultrasonic waves, and a moving member (not illustrated) that moves the cutter 132.

Figure 10:
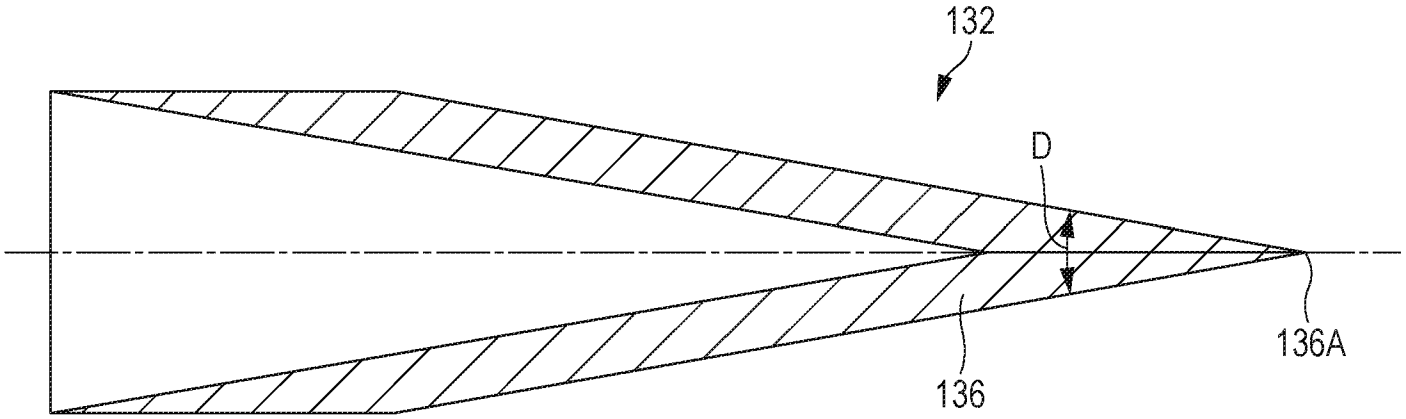
FIG. 10 is a plan view of a blade included in the end processing apparatus used in manufacturing the charging roller according to the exemplary embodiment of the present invention.

The cutter 132 is made of, for example, carbon steel having a Young's modulus of 1,000 Gpa. Seen in the apparatus-depth direction, the cutter 132 is oriented at an angle with respect to the axis of rotation of the unprocessed rubber roller 72. The edge 136A of the blade 136 of the cutter 132 faces an outer peripheral surface 70C of the rubber roller member 70. The cutter 132 has a thickness of 1 mm at the proximal end thereof. Referring to FIG. 10, the blade 136 of the cutter 132 is tapered such that, seen in the thickness direction of the blade 136, the size in the width direction thereof is gradually reduced. The angle of the edge 136A (denoted by reference numeral D in FIG. 10) is, for example, 20°.

The cutter 132 has an amorphous carbon structure (made of tetrahedral amorphous carbon) deposited on the surface thereof. In the present exemplary embodiment, the amorphous carbon structure has a degree of amorphousness (proportion of the amorphous substance) of 60% or higher. The degree of amorphousness is measurable by X-ray diffractometry.

Referring to FIG. 5, the driving unit 134 includes a supporting portion 134A that supports the cutter 132. The driving unit 134 moves the cutter 132 between a retracted position and a cutting position. When the cutter 132 is at the retracted position, the edge 136A of the cutter 132 faces the outer peripheral surface 70C of the rubber roller member 70 with a space interposed therebetween and is at an angle with respect to the axis of rotation of the unprocessed rubber roller 72 (see FIG. 5 and FIG. 6A). As the cutter 132 is moved to the cutting position, the edge 136A of the cutter 132 is inserted into the rubber roller member 70 in a direction at an angle with respect to the axis of rotation of the unprocessed rubber roller 72 and passes through the end face 70A of the rubber roller member 70 (see FIG. 7B).

As described above, the driving unit 134 moves the cutter 132 in a direction at an angle with respect to the axis of rotation of the unprocessed rubber roller 72 when seen in the apparatus-depth direction. In the present exemplary embodiment, the driving unit 134 moves the cutter 132 at a speed of 0.3 mm/sec.

Furthermore, the driving unit 134 transmits ultrasonic oscillation to the cutter 132 through the supporting portion 134A. Thus, the cutter 132 oscillates in the direction of movement of the cutter 132 with an amplitude of 15 μm or greater and 30 μm or less and at a frequency of 40 kHz.

In the above configuration, the driving unit 134 inserts the cutter 132 into the rubber roller member 70 from the outer peripheral surface 70C of the rubber roller member 70 while oscillating the cutter 132 in the direction in which the cutter 132 is moved. Thus, the blade 136 of the cutter 132 cuts each of the corners 70B of the rubber roller member 70, whereby the rubber roller portion 62 having the chamfered portions 62A (see FIG. 4) is obtained.

In the present exemplary embodiment, the chamfered portions 62A each have a length of chamfering (a length L in FIG. 6A) of 2 mm, and the angle of the cutter 132 with respect to the axis of rotation of the unprocessed rubber roller 72 (an angle G in FIG. 6A) is 20°.

Supporting Pad

The supporting pad 146 has an annular shape having a through hole through which the shaft member 64 is allowed to pass. Referring to FIG. 5, the supporting pad 146 is positioned across the corner 70B of the rubber roller member 70 from the edge 136A of the cutter 132. The supporting pad 146 is fixed to the shaft member 64 with a fixing member (not illustrated). The supporting pad 146 according to the present exemplary embodiment is made of urethane.

The supporting pad 146 is configured to rotate together with the unprocessed rubber roller 72 in a rotating step to be described later and to support a part of the end face 70A of the rubber roller member 70 in the cutting step to be described later (see FIGS. 7A and 7B).

When the cutter 132 is at the retracted position, a clearance of 0.5 mm is provided between the supporting pad 146 and the end face 70A of the rubber roller member 70.

Blowing Member

Referring to FIG. 5, the blowing member 138 is positioned above the edge 136A of the cutter 132 that is at the retracted position, and blows air toward the corner 70B of the rubber roller member 70. Thus, the blowing member 138 blows off chips and filings generated when the corner 70B of the rubber roller member 70 is cut off by the blade 136.

Other Elements

Figure 9:
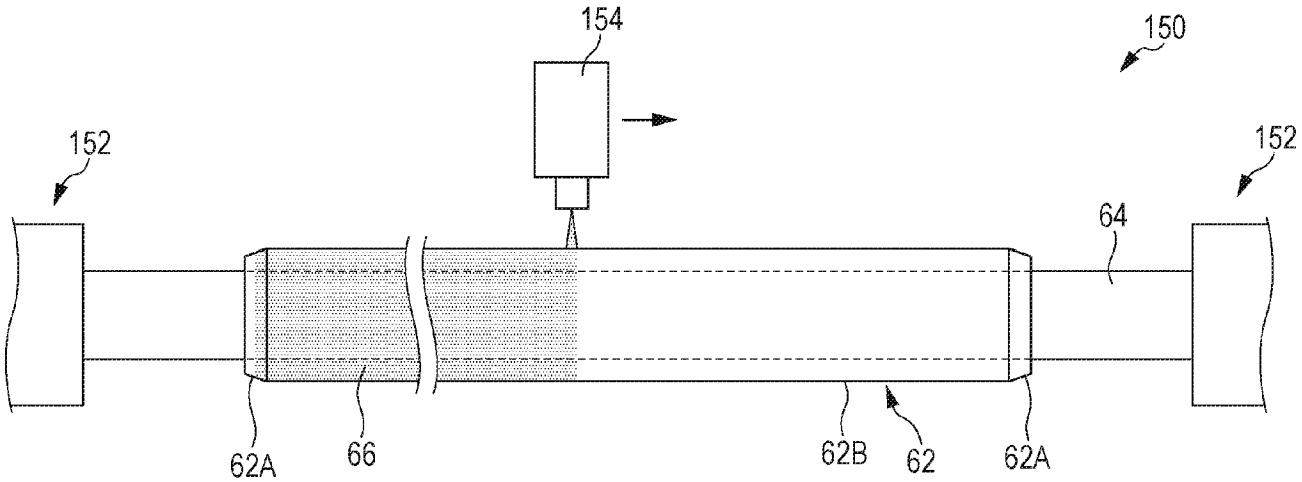
FIG. 9 is a front view of an application apparatus used in manufacturing the charging roller according to the exemplary embodiment of the present invention.

Now, an application apparatus 150 will be described. The application apparatus 150 forms the electrically conductive coating film 66 over the rubber roller portion 62 obtained after the corners 70B of the rubber roller member 70 are cut off. The application apparatus 150 forms the electrically conductive coating film 66 over the rubber roller portion 62 by so-called flow coating and includes, as illustrated in FIG. 9, rotating members 152 that support the two respective ends of the shaft member 64 and rotate the rubber roller portion 62. The application apparatus 150 further includes an ejecting unit 154 positioned above the rubber roller portion 62 and being movable in the axial direction of the shaft member 64. The ejecting unit 154 ejects coating liquid toward the rubber roller portion 62 while moving in the axial direction of the shaft member 64, whereby the electrically conductive coating film 66 is formed over the rubber roller portion 62.

The electrically conductive coating film 66 prevents the rubber roller portion 62 from being contaminated with external additives contained in toner and other substances.

Method of Manufacturing Charging Roller

Now, a method of manufacturing the charging roller 60 by using the end processing apparatus 100 and associated devices will be described.

Step of Making Unprocessed Rubber Roller

In a step of making the unprocessed rubber roller 72, a round-cylindrical or substantially round-cylindrical rubber member composed of electrically conductive rubber and other miscellaneous substances is provided around the shaft member 64 by extrusion molding, and two ends of the rubber member are cut off, so that the two ends of the shaft member 64 are exposed. Thus, the unprocessed rubber roller 72 including the shaft member 64 and the rubber roller member 70 is obtained. In this step, when the two ends of the rubber member are cut off, a residual stress in the rubber member is released, and the two ends of the rubber roller member 70 are curled up.

Preparation Step

In a preparation step, as illustrated in FIG. 5, the supporting pad 146 is attached to the exposed end of the shaft member 64 that is on one side (the right side in FIG. 5) in the apparatus-width direction. Furthermore, the two ends of the shaft member 64 of the unprocessed rubber roller 72 are supported by the rotating device 120. Note that the cutter 132 is at the retracted position.

In the above state, the cutter 132 at the retracted position is at an angle with respect to the axis of rotation of the unprocessed rubber roller 72 when seen in the apparatus-depth direction, the edge 136A of the cutter 132 faces the outer peripheral surface 70C of the rubber roller member 70, and the supporting pad 146 is positioned across the corner 70B of the rubber roller member 70 from the edge 136A of the cutter 132.

Rotating Step

Figure 6A:
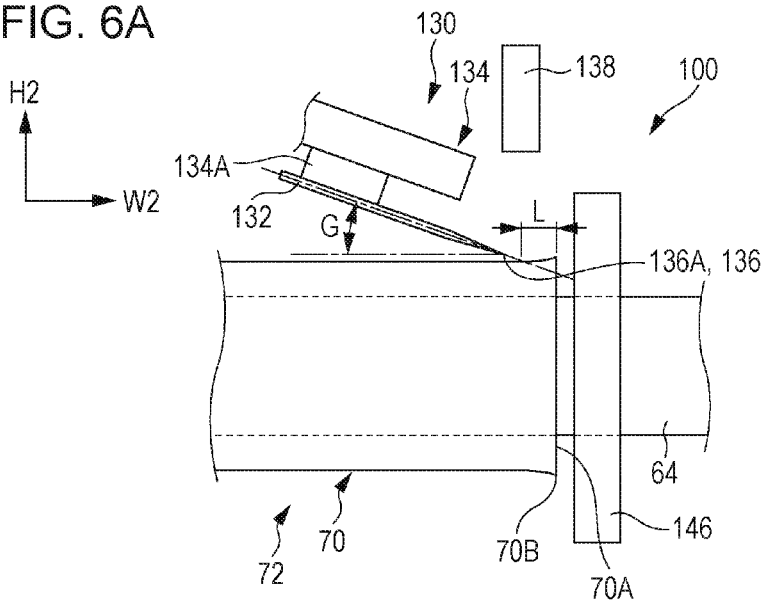
FIGS. 6A and 6B are other front views of the end processing apparatus used in manufacturing the charging roller according to the exemplary embodiment of the present invention.
Figure 6B:
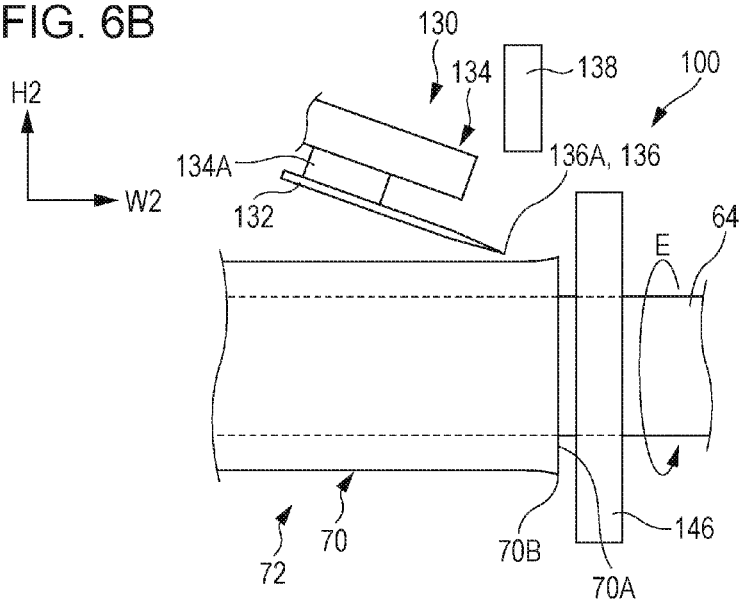

In a rotating step, as illustrated in FIGS. 5 and 6B, the rotating device 120 rotates the unprocessed rubber roller 72 in the peripheral direction of the rubber roller member 70 (as indicated by the arrow E in FIGS. 5 and 6B).

Cutting Step

In a cutting step, the blowing member 138 blows air toward the corner 70B of the rubber roller member 70. Furthermore, as illustrated in FIGS. 6B and 7A, the driving unit 134 moves the cutter 132 from the retracted position to the cutting position while oscillating the cutter 132. Thus, the edge 136A of the cutter 132 is inserted into the rubber roller member 70 from the outer peripheral surface 70C of the rubber roller member 70 that is rotating. Then, a part of the rubber roller member 70 into which the edge 136A has been inserted is deformed, and a part of the end face 70A of the rubber roller member 70 comes into contact with and is thus supported by the supporting pad 146.

Figure 7A:
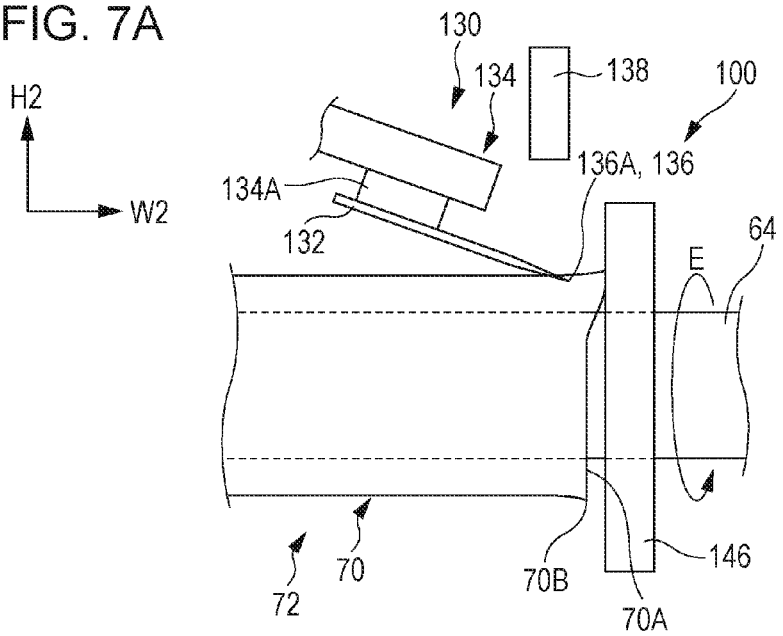
FIGS. 7A and 7B are yet other front views of the end processing apparatus used in manufacturing the charging roller according to the exemplary embodiment of the present invention.
Figure 7B:
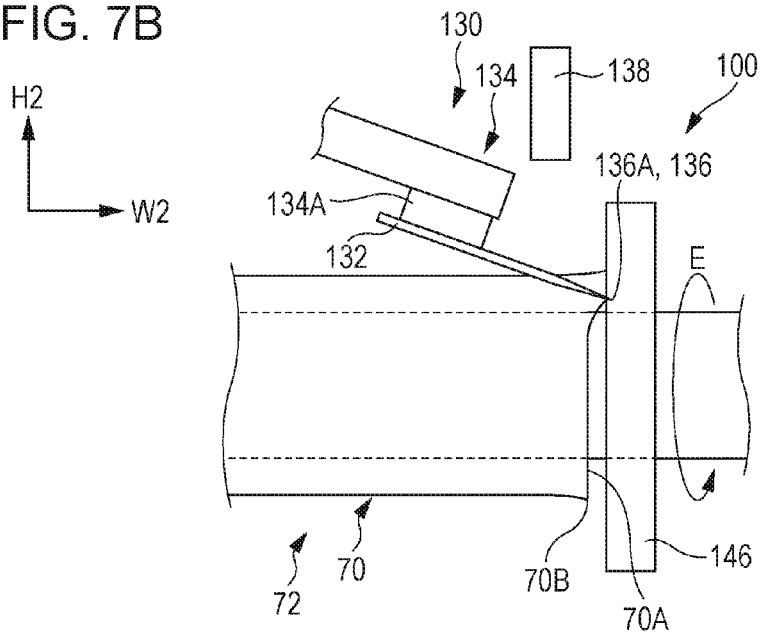

Furthermore, as illustrated in FIGS. 7A and 7B, the edge 136A of the cutter 132 that is being moved passes through the end face 70A of the rubber roller member 70, and the cutter 132 reaches the cutting position. When the cutter 132 reaches the cutting position, the driving unit 134 stops moving the cutter 132. Subsequently, the rotating device 120 rotates the rubber roller member 70 by at least one revolution and then stops rotating the rubber roller member 70.

Figure 8A:
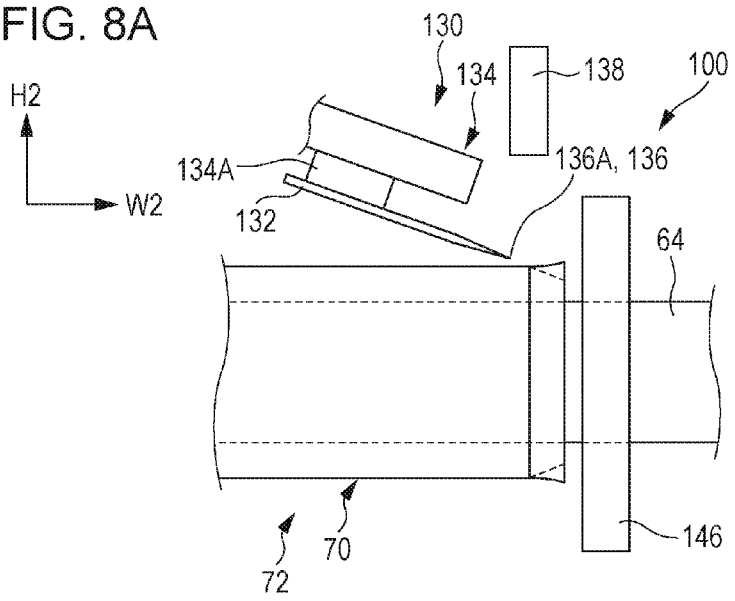
FIG. 8A is a yet another front view of the end processing apparatus used in manufacturing the charging roller according to the exemplary embodiment of the present invention.

After the rotation of the rubber roller member 70 is stopped, the driving unit 134 stops oscillating the cutter 132 that is at the cutting position, and moves the cutter 132 to the retracted position as illustrated in FIG. 8A.

Figure 8B:
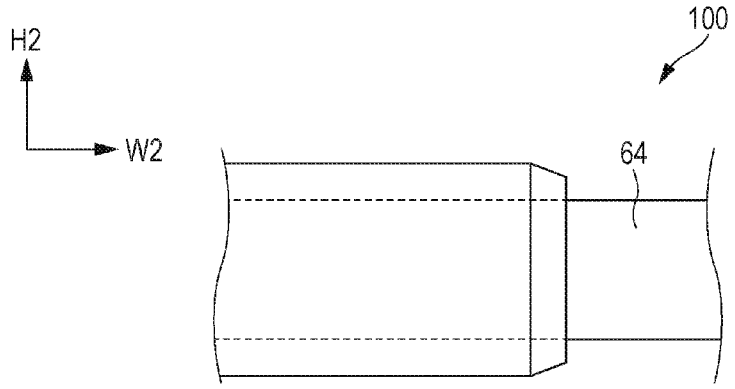
FIG. 8B is a front view of an end of the charging roller according to the exemplary embodiment of the present invention.

Furthermore, the rotating device 120 releases the two ends of the shaft member 64 of the unprocessed rubber roller 72, and the supporting pad 146 is removed from the shaft member 64 as illustrated in FIG. 8B.

Thus, the corner 70B of the rubber roller member 70 that is on one side in the apparatus-width direction is cut off, that is, the one end of the rubber roller member 70 is chamfered. Subsequently, the unprocessed rubber roller 72 is turned the other way, and the above steps are repeated, whereby the corner 70B of the rubber roller member 70 that is on the other side in the apparatus-width direction is cut off. Thus, the rubber roller portion 62 including the chamfered portions 62A is obtained.

As described above, the corners 70B of the rubber roller member 70 are each cut off by inserting the blade 136 of the cutter 132 from the outer peripheral surface 70C of the rubber roller member 70 that is rotating into the rubber roller member 70 while oscillating the cutter 132. Therefore, the chamfered portions 62A each have the helical groove 68 (see FIGS. 1A and 1B).

Application Step

In an application step, as illustrated in FIG. 9, the two ends of the shaft member 64 are supported by the rotating members 152, and the shaft member 64 having the rubber roller portion 62 is rotated by the rotating members 152. Furthermore, the ejecting unit 154 ejects the coating liquid toward the rubber roller portion 62 while moving in the axial direction of the shaft member 64. Thus, the electrically conductive coating film 66 is formed over the rubber roller portion 62.

Through the above steps, as illustrated in FIG. 4, the charging roller 60 coated with the electrically conductive coating film 66 from a part of the chamfered portion 62A on one side to a part of the chamfered portion 62A on the other side is obtained.

Evaluation

Charging rollers 60 as working examples and charging rollers as comparative examples are evaluated as follows.

[Specifications]

Working Example 1: Surface roughness of chamfered portions 62A: 30 μm

Working Example 2: Surface roughness of chamfered portions 62A: 40 μm

Working Example 3: Surface roughness of chamfered portions 62A: 50 μm

[Comparative Example 1]: Surface roughness of chamfered portions: 90 μm

[Comparative Example 2]: Surface roughness of chamfered portions: 100 μm

[Comparative Example 3]: Surface roughness of chamfered portions: 110 μm

Note that the surface roughness of the chamfered portions in each of Comparative Examples 1 to 3 is increased by abolishing a surface treatment given to the blade 136.

[Conditions for Evaluation]

The charging rollers 60 as Working Examples 1 to 3 and the charging rollers as Comparative Examples 1 to 3 are each attached to an image forming apparatus (DocuCentre Color a450) of Fuji Xerox Co., Ltd., and images are formed on A3-size sheet members by using the image forming apparatus.

Specifically, an image of an area coverage of 5% is formed on each of 30,000 A3-size sheet members in an environment at a low temperature (10° C.) and a low humidity (20% in relative humidity (RH)). Subsequently, an image of an area coverage of 5% is formed on each of 30,000 A3-size sheet members in an environment at a high temperature (28° C.) and a high humidity (75% in RH).

After the above images are formed on the total of 60,000 sheet members, the presence of any wrinkles and peelings of the electrically conductive coating film 66 at the chamfered portions (62A) is checked visually.

[Criteria and Results of Evaluation]

A: No wrinkles nor peelings are observed

B: Wrinkles and/or peelings are observed

FIG. 3 is a table that summarizes the results of the evaluation. As summarized in the table in FIG. 3, Working Examples 1 to 3 are each evaluated as "A," whereas Comparative Examples 1 to 3 are each evaluated as "B."

[Review]

Figure 2A:
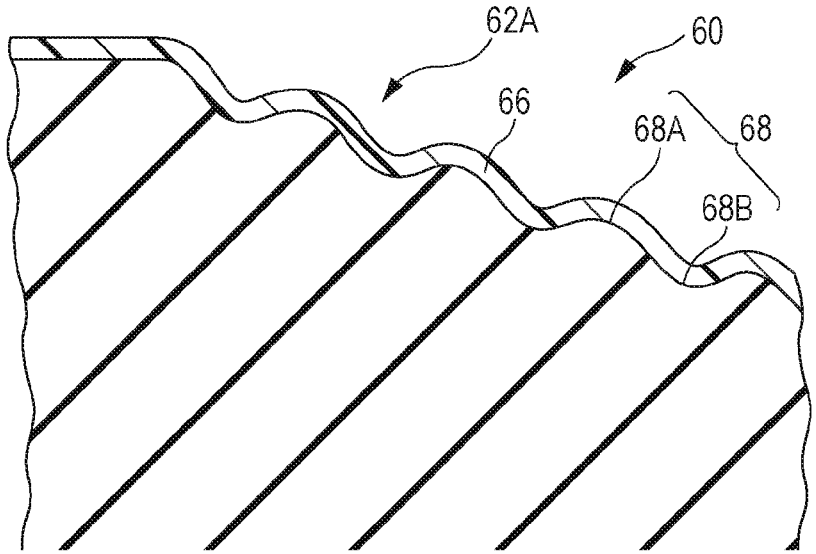
FIG. 2A is a sectional view of a chamfered portion of a charging roller made as a working example according to the exemplary embodiment of the present invention.

The surface roughness of the chamfered portions 62A of each of the charging rollers 60 as Working Examples 1 to 3 is 50 μm or less. Therefore, as illustrated in FIG. 2A, the difference between the thickness of the electrically conductive coating film 66 at each of ridges 68A of the helical groove 68 and the thickness of the electrically conductive coating film 66 at each of troughs 68B of the helical groove 68 is small. In other words, the degree of change in the thickness of the electrically conductive coating film 66 is low, which is considered to be the reason for the absence of wrinkles and peelings in the electrically conductive coating film 66.

Figure 2B:
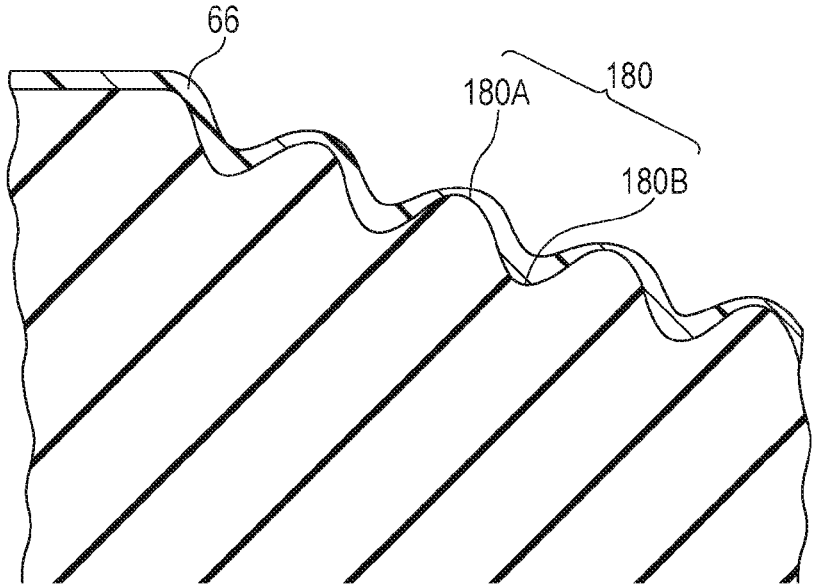
FIG. 2B is a sectional view of a chamfered portion of a charging roller made as a comparative example.

In contrast, the surface roughness of the chamfered portions of each of the charging rollers as Comparative Examples 1 to 3 is greater than 50 μm. Therefore, as illustrated in FIG. 2B, the thickness of the electrically conductive coating film 66 at each of ridges 180A of a groove 180 is smaller than that at each of the ridges 68A of any of Working Examples 1 to 3, whereas the thickness of the electrically conductive coating film 66 at each of troughs 180B of the groove 180 is larger than that at each of the troughs 68B of any of Working Examples 1 to 3. In other words, the degree of change in the thickness of the electrically conductive coating film 66 is greater than that of Working Examples 1 to 3, which is considered to be the reason for the presence of wrinkles and peelings in the electrically conductive coating film 66.

SUMMARY

As is obvious from the above results of the evaluation, since the surface roughness of the chamfered portions 62A is set to 50 μm or about 50 μm or less, the probability of the occurrence of wrinkles and peelings of the electrically conductive coating film 66 formed over the chamfered portions 62A is made lower than in the case where the surface roughness of the chamfered portions is greater than 50 μm.

The chamfered portions 62A each have the helical groove 68, which is one continuous groove. Such a configuration is free from the possibility that the electrically conductive coating film 66 may peel at connections of plural grooves. Therefore, the peeling of the electrically conductive coating film 66 is suppressed, compared with the case of the chamfered portion having a plural grooves.

Since the peeling of the electrically conductive coating film 66 is suppressed, the occurrence of nonuniform charging of the surface of the image carrier 36 is suppressed.

In the image forming apparatus 10, since the occurrence of nonuniform changing of the surface of the image carrier 36 is suppressed, the deterioration in the quality of an image outputted is suppressed.

In the above exemplary embodiment, the groove 68 is helical. Alternatively, the groove 68 is not limited to be helical. If the groove 68 is not helical, however, the effect produced by the helical shape of the groove 68 is not produced.

The above exemplary embodiment concerns a case where the groove 68 is provided in each of the chamfered portions 62A. Alternatively, the groove 68 may not necessarily be provided in the chamfered portion 62A.

The above exemplary embodiment concerns a case where a part of each of the chamfered portions 62A is coated with the electrically conductive coating film 66. Alternatively, the entirety of each of the chamfered portions 62A may be coated with the electrically conductive coating film 66.

The above exemplary embodiment concerns a case where the roller member corresponds to the charging roller 60. Alternatively, the roller member may be a transfer roller, a transport roller, or the like.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A roller member comprising:

a core member;

a round-cylindrical elastic member through which the core member extends, wherein the round-cylindrical elastic member comprises chamfered portions, wherein the chamfered portions are each provided at two respective ends of the round-cylindrical elastic member and have a surface roughness of about 50 μm or less; and a coating film provided over an outer peripheral surface of the round-cylindrical elastic member and at least a part of each of the chamfered portions, wherein the chamfered portions each have a helical groove, wherein the helical groove is formed only in the chamfered portions.

2. The roller member according to claim 1, wherein the coating film is provided over only a part of each of the chamfered portions.

3. The roller member according to claim 1, wherein the coating film is provided over the entirety of each of the chamfered portions.

4. The roller member according to claim 1, wherein the coating film is an electrically conductive coating film, and wherein the roller member rotates by following rotation of a rotating image carrier and charges the image carrier with a potential difference produced between the roller member and the rotating image carrier.

5. An image carrier device comprising:

the roller member according to claim 4.

6. An image forming apparatus comprising:

the roller member according to claim 4;

a forming unit that forms an image on the rotating image carrier that is charged; and a transfer unit that transfers the image formed on the rotating image carrier to a transfer object.

* * * * *